US008893955B2

(12) United States Patent
Clark et al.

(10) Patent No.: US 8,893,955 B2
(45) Date of Patent: Nov. 25, 2014

(54) RELEASABLY CLOSABLE PRODUCT ACCOMMODATING PACKAGE

(75) Inventors: Kerri Clark, Morristown, NJ (US); Brian Hawthorne, Bloomington, IN (US); Maximiliano Rodriguez, Bridgewater, NJ (US); Allen Sydney Aldridge, Morris Plains, NJ (US); Simon Richard Gainey, Media, PA (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 0 days.

(21) Appl. No.: 13/880,118

(22) PCT Filed: Oct. 27, 2011

(86) PCT No.: PCT/US2011/057982

§ 371 (c)(1),
(2), (4) Date: Aug. 27, 2013

(87) PCT Pub. No.: WO2012/058367

PCT Pub. Date: May 3, 2012

(65) Prior Publication Data

US 2013/0327820 A1 Dec. 12, 2013

Related U.S. Application Data

(60) Provisional application No. 61/407,385, filed on Oct. 27, 2010, provisional application No. 61/408,112, filed on Oct. 29, 2010, provisional application No. 61/408,091, filed on Oct. 29, 2010.

(51) Int. Cl.

| | |
|---|---|
| ***B65D 5/4805*** | (2006.01) |
| ***B65D 43/22*** | (2006.01) |
| ***B65D 5/42*** | (2006.01) |
| ***B65D 5/00*** | (2006.01) |
| ***B65D 85/60*** | (2006.01) |
| ***B65D 5/64*** | (2006.01) |
| ***B65D 77/00*** | (2006.01) |

(52) U.S. Cl.

CPC ..... *B65D 5/427* (2013.01); *B65D 5/0085* (2013.01); *B65D 85/60* (2013.01); *B65D 5/643* (2013.01); *B65D 77/006* (2013.01); *B65D 2313/04* (2013.01)

USPC ..... 229/120.09; 229/120.18; 229/125.37

(58) Field of Classification Search

USPC ..... 229/120.01, 120.09, 120.011, 120.18, 229/87.07, 125.37, 125.39, 146, 153; 206/38, 256, 257, 264, 800

See application file for complete search history.

(56) References Cited

U.S. PATENT DOCUMENTS 1,805,371 A * 5/1931 Molins ..... 229/120.09
2,296,389 A * 9/1942 Levkoff ..... 229/120.09

(Continued)

FOREIGN PATENT DOCUMENTS

DE 1604415 8/1974
DE 3626360 C2 2/1988

(Continued)

OTHER PUBLICATIONS

English Translation of JPA 1997-024927.

*Primary Examiner* — Gary Elkins

(74) *Attorney, Agent, or Firm* — Hoffmann & Baron, LLP

(57) ABSTRACT

A releasable closure provides for the opening and closing of a package assembly which accommodates a plurality of elongate consumable products. The assembly includes a package housing for supporting the products. The package housing includes a first product accommodating compartment and a second product accommodating compartment separated by a hinge. Each of the product accommodating compartments has an open end adjacent the hinge. The product accommodating compartments are foldable about the hinge in a book-like fashion. The releasable closure is applied to each compartment and positioned to be in aligned facing relationship for mutual engagement upon closably folding the compartments about the hinge.

15 Claims, 6 Drawing Sheets

(56) References Cited

U.S. PATENT DOCUMENTS 2,688,507 A * 9/1954 Ashworth ..... 229/125.39
2,690,206 A 9/1954 Mueller
2,784,757 A 3/1957 Bosca et al.
2,964,793 A 12/1960 Blume, Jr.
2,999,275 A 9/1961 Blume, Jr.
3,021,230 A 2/1962 Deriaud
3,023,123 A 2/1962 Colwill et al.
3,033,707 A 5/1962 Lacy et al.
3,117,092 A 1/1964 Parker
3,127,544 A 3/1964 Blume, Jr.
3,163,922 A 1/1965 Brailowsky
3,191,106 A 6/1965 Baermann
3,206,655 A 9/1965 Reijnst
3,221,315 A 11/1965 Brown, Jr. et al.
3,256,112 A 6/1966 Camras
3,325,084 A * 6/1967 Ausnit ..... 229/125.37
3,326,399 A 6/1967 Ausnit
3,417,675 A 12/1968 Ausnit
3,470,055 A 9/1969 Wade
3,616,191 A 10/1971 Fuerholzer et al.
3,749,301 A 7/1973 Peckar
3,764,539 A 10/1973 Cochardt et al.
3,766,642 A 10/1973 Schlaudt et al.
3,810,055 A 5/1974 Wright
3,818,861 A 6/1974 Turner
3,855,374 A 12/1974 Brailowsky et al.
3,858,136 A 12/1974 Jun
3,867,299 A 2/1975 Rohatgi
3,897,288 A 7/1975 Fayling
3,903,228 A 9/1975 Riedl et al.
3,960,629 A 6/1976 Goldsworthy
3,961,721 A 6/1976 Gordon et al.
3,985,604 A 10/1976 Balla
4,022,701 A 5/1977 Sawa et al.
4,033,013 A 7/1977 Peterson
4,056,344 A 11/1977 Lemelson
4,058,335 A 11/1977 Abe
4,062,922 A 12/1977 Olson et al.
4,093,693 A 6/1978 Lemelson
4,101,904 A 7/1978 Weigl et al.
4,128,386 A 12/1978 Wissinger et al.
4,140,463 A 2/1979 Brinkmann et al.
4,234,378 A 11/1980 Iwasaki et al.
4,292,261 A 9/1981 Kotani et al.
4,297,388 A 10/1981 Kumar et al.
4,308,155 A 12/1981 Tada et al.
4,310,978 A 1/1982 Stern
4,333,602 A 6/1982 Geschwender
4,376,726 A 3/1983 Sakaira et al.
4,379,276 A 4/1983 Bouchara et al.
4,386,182 A 5/1983 Zijp
4,388,349 A 6/1983 Korpman et al.
4,412,929 A 11/1983 Lysenko et al.
4,427,481 A 1/1984 Smith et al.
4,455,184 A 6/1984 Thompson
4,479,838 A 10/1984 Dunsirn et al.
4,493,778 A 1/1985 Iqbal
4,543,551 A 9/1985 Petersen
4,545,838 A 10/1985 Minkus et al.
4,588,209 A 5/1986 Zebrowski et al.
4,593,736 A 6/1986 Morita
4,606,976 A 8/1986 Hensel et al.
4,621,837 A 11/1986 Mack
4,693,775 A 9/1987 Harrison et al.
4,728,419 A 3/1988 Grun
4,738,390 A 4/1988 Brennan
4,749,434 A 6/1988 Harrison
4,823,943 A 4/1989 Chang
4,835,624 A 5/1989 Black et al.
4,836,378 A 6/1989 Lephardt
4,857,594 A 8/1989 Lakshmanan et al.
4,902,141 A 2/1990 Linnewiel
4,902,361 A 2/1990 Lee et al.
4,921,646 A 5/1990 Stewart
4,931,092 A 6/1990 Cisar et al.
4,941,935 A 7/1990 Gregory
4,944,802 A 7/1990 Chagnon et al.
4,948,038 A 8/1990 Moeller
4,983,231 A 1/1991 Yamanaka et al.
4,996,110 A 2/1991 Tanuma et al.
5,002,677 A 3/1991 Srail et al.
5,019,436 A 5/1991 Schramer et al.
5,073,435 A 12/1991 Eyraud et al.
5,107,238 A 4/1992 Leupold
5,114,517 A 5/1992 Rippingale et al.
5,125,211 A 6/1992 O'Brien et al.
5,135,012 A 8/1992 Kamen et al.
5,148,916 A 9/1992 Tillyer, Sr.
5,194,299 A 3/1993 Fry
5,217,307 A * 6/1993 McClintock ..... 229/123.2
5,256,326 A 10/1993 Kawato et al.
5,350,558 A 9/1994 Kawato et al.
5,397,843 A 3/1995 Lakshmanan et al.
5,424,703 A 6/1995 Blume, Jr.
5,428,332 A 6/1995 Srail et al.
5,458,282 A 10/1995 Martin
5,464,670 A 11/1995 Ikuma et al.
5,478,891 A 12/1995 Lakshmanan et al.
5,482,982 A 1/1996 Lakshmanan et al.
5,503,891 A 4/1996 Marshall et al.
5,505,305 A 4/1996 Scholz et al.
5,505,620 A 4/1996 Barlett
5,510,412 A 4/1996 Suzuki et al.
5,524,317 A 6/1996 Nagahama et al.
5,525,649 A 6/1996 Nishimura et al.
5,562,309 A * 10/1996 Brink et al. ..... 281/15.1
5,567,757 A 10/1996 Szczepanski
5,570,167 A 10/1996 Kuroda
5,578,670 A 11/1996 Nakazawa et al.
5,641,116 A 6/1997 Martin
5,665,429 A 9/1997 Elwakil
5,676,307 A 10/1997 Martin
5,676,791 A 10/1997 Cristel
5,687,848 A 11/1997 Scholz et al.
5,699,956 A 12/1997 Brennan
5,704,480 A 1/1998 Scholz et al.
5,740,509 A 4/1998 Hibi et al.
5,762,263 A 6/1998 Chamberlain, IV
5,772,022 A 6/1998 Renna
5,788,073 A 8/1998 Suryk
5,803,351 A 9/1998 Nielsen
5,843,329 A 12/1998 Deetz
5,844,458 A 12/1998 Bartholomew et al.
5,868,498 A 2/1999 Martin
5,869,148 A 2/1999 Silverschotz et al.
5,879,784 A 3/1999 Breen et al.
5,888,416 A 3/1999 Ikuma et al.
5,891,204 A 4/1999 Neff
5,924,624 A 7/1999 Martin
5,932,134 A 8/1999 Christ et al.
5,942,961 A 8/1999 Srail et al.
5,949,050 A 9/1999 Fosbenner et al.
5,964,399 A * 10/1999 Ruben ..... 229/125.39
5,983,537 A 11/1999 Johnson
5,985,080 A 11/1999 Kobayashi et al.
5,985,435 A 11/1999 Czaplicki et al.
5,990,218 A 11/1999 Hill et al.
5,994,990 A 11/1999 Ogikubo
6,024,277 A 2/2000 Martin
6,127,002 A 10/2000 Callahan, Jr. et al.
6,134,821 A 10/2000 Love
6,153,279 A 11/2000 Charley
6,171,107 B1 1/2001 Milne
6,190,573 B1 2/2001 Ito
6,228,933 B1 5/2001 Hiles
6,262,174 B1 7/2001 Cooper et al.
6,304,162 B1 10/2001 Nakatsuka et al.
6,312,795 B1 11/2001 Yamamoto
6,338,436 B1 1/2002 Iguchi et al.
6,387,485 B1 5/2002 Bielek et al.
6,436,520 B1 8/2002 Yamamoto
6,451,221 B1 9/2002 Hart et al.
6,464,894 B1 10/2002 Antochin et al.
6,468,678 B1 10/2002 Dahlin et al.

(56) References Cited

U.S. PATENT DOCUMENTS

| | | | |
|---|---|---|---|
| 6,476,113 | B1 | 11/2002 | Hiles |
| 6,478,982 | B1 | 11/2002 | Anamoto et al. |
| 6,494,968 | B1 | 12/2002 | Hamano et al. |
| 6,496,675 | B1 | 12/2002 | Sugiyama et al. |
| 6,547,626 | B1 | 4/2003 | Burrows |
| 6,596,096 | B2 | 7/2003 | Carl et al. |
| 6,610,415 | B2 | 8/2003 | Koslow |
| 6,673,999 | B1 | 1/2004 | Wang et al. |
| 6,693,506 | B2 | 2/2004 | Matsumura et al. |
| 6,702,845 | B1 | 3/2004 | Cully et al. |
| 6,707,361 | B2 | 3/2004 | Blume |
| 6,713,671 | B1 | 3/2004 | Wang et al. |
| 6,714,114 | B2 | 3/2004 | Matsumura et al. |
| 6,726,781 | B2 | 4/2004 | Walmer et al. |
| 6,749,551 | B2 | 6/2004 | Metzler et al. |
| 6,749,750 | B2 | 6/2004 | Barbera-Guillem et al. |
| 6,764,732 | B2 | 7/2004 | Stefanutti et al. |
| 6,773,765 | B1 | 8/2004 | Gambino et al. |
| 6,774,171 | B2 | 8/2004 | Kassa et al. |
| 6,783,798 | B2 | 8/2004 | Koslow |
| 6,784,255 | B1 | 8/2004 | Nakahama et al. |
| 6,790,378 | B2 | 9/2004 | Graham et al. |
| 6,823,803 | B2 | 11/2004 | Preisler |
| 6,853,280 | B2 | 2/2005 | Sugawara et al. |
| 6,864,418 | B2 | 3/2005 | Wang et al. |
| 6,872,325 | B2 | 3/2005 | Bandyopadhyay et al. |
| 6,881,450 | B1 | 4/2005 | Texier |
| 6,925,739 | B1 | 8/2005 | Cole et al. |
| 7,001,645 | B1 | 2/2006 | Texier |
| 7,128,798 | B2 | 10/2006 | Boudouris et al. |
| 7,156,252 | B2 | 1/2007 | Morin |
| 7,159,717 | B2 | 1/2007 | Aldridge et al. |
| 7,192,628 | B2 | 3/2007 | Burrows |
| 7,300,395 | B2 | 11/2007 | Sleight et al. |
| 7,325,686 | B2 | 2/2008 | Aldridge |
| 7,338,573 | B2 | 3/2008 | Boudouris et al. |
| 7,344,653 | B2 | 3/2008 | Polak et al. |
| 7,366,454 | B2 | 4/2008 | Nakamura et al. |
| 7,381,280 | B2 | 6/2008 | Yamashita |
| 7,381,450 | B1 | 6/2008 | Waltham et al. |
| 7,441,580 | B2 | 10/2008 | Lee |
| 7,481,355 | B2 | 1/2009 | Hui |
| 7,501,921 | B2 | 3/2009 | Richards et al. |
| 7,527,189 | B2 | 5/2009 | Billig et al. |
| 7,568,566 | B2 | 8/2009 | D'Ambrosio |
| 7,629,046 | B2 | 12/2009 | van Driesten |
| 7,728,706 | B2 | 6/2010 | Ogden, Jr. et al. |
| 7,806,309 | B2 | 10/2010 | Korchmar |
| 7,838,589 | B2 | 11/2010 | Finerman et al. |
| 2001/0001470 | A1* | 5/2001 | Toussant et al. ..... 229/107 |
| 2001/0040493 | A1 | 11/2001 | Bloom |
| 2002/0043301 | A1 | 4/2002 | Walmer et al. |
| 2003/0030027 | A1 | 2/2003 | Graham et al. |
| 2003/0098436 | A1 | 5/2003 | Graham et al. |
| 2004/0009370 | A1 | 1/2004 | Abe |
| 2004/0191573 | A1 | 9/2004 | Fuller et al. |
| 2005/0064242 | A1 | 3/2005 | Schneider et al. |
| 2005/0174004 | A1 | 8/2005 | Takehara et al. |
| 2005/0230468 | A1 | 10/2005 | Roth |
| 2005/0242097 | A1 | 11/2005 | Morin |
| 2005/0274454 | A1 | 12/2005 | Extrand |
| 2006/0035087 | A1 | 2/2006 | Yadav et al. |
| 2006/0165880 | A1 | 7/2006 | Boudouris et al. |
| 2006/0166026 | A1 | 7/2006 | Boudouris et al. |
| 2006/0234046 | A1 | 10/2006 | Wu |
| 2006/0283750 | A1 | 12/2006 | Villars et al. |
| 2008/0099151 | A1 | 5/2008 | Lee |
| 2008/0190801 | A1 | 8/2008 | Kwok |
| 2008/0196288 | A1 | 8/2008 | Turner |
| 2009/0130448 | A1 | 5/2009 | Morrissey et al. |
| 2009/0188593 | A1 | 7/2009 | Cameron |
| 2009/0191401 | A1 | 7/2009 | Deetz |
| 2009/0194205 | A1 | 8/2009 | Loffler et al. |
| 2009/0263634 | A1 | 10/2009 | Hyer et al. |
| 2010/0012881 | A1 | 1/2010 | Aramaki |
| 2010/0028667 | A1 | 2/2010 | Love |
| 2010/0040845 | A1 | 2/2010 | Schmid et al. |
| 2010/0098921 | A1 | 4/2010 | Burrows |
| 2010/0116641 | A1 | 5/2010 | Carlson |
| 2010/0181311 | A1 | 7/2010 | Costecalde |
| 2010/0206757 | A1 | 8/2010 | Kesselman |
| 2010/0247973 | A1 | 9/2010 | Stout et al. |
| 2010/0276313 | A1 | 11/2010 | Nakano et al. |
| 2011/0020642 | A1 | 1/2011 | Yaguchi et al. |

FOREIGN PATENT DOCUMENTS

| | | | |
|---|---|---|---|
| DE | 10 2007 018 772 | A1 | 11/2007 |
| EP | 1683736 | A2 | 7/2006 |
| EP | 1747999 | A1 | 1/2007 |
| EP | 1801032 | A1 | 6/2007 |
| EP | 1598279 | B1 | 3/2008 |
| EP | 2112079 | A1 | 10/2009 |
| EP | 2233407 | A1 | 9/2010 |
| FR | 1496551 | | 9/1967 |
| FR | 2 043 987 | | 2/1971 |
| FR | 2885132 | A1 | 11/2006 |
| GB | 875807 | | 8/1961 |
| GB | 882712 | | 11/1961 |
| GB | 1025616 | | 4/1966 |
| GB | 1116861 | | 6/1968 |
| GB | 1121773 | | 7/1968 |
| GB | 1444858 | | 8/1976 |
| GB | 2385841 | A | 9/2003 |
| JP | 58-178508 | | 10/1983 |
| JP | 60-041203 | | 3/1985 |
| JP | 60-118774 | | 6/1985 |
| JP | 60-164919 | | 8/1985 |
| JP | 63-075080 | | 4/1988 |
| JP | 63-127507 | | 5/1988 |
| JP | 01-311201 | | 12/1989 |
| JP | 03-059050 | | 3/1991 |
| JP | 06-298955 | | 10/1994 |
| JP | 06-324591 | | 11/1994 |
| JP | 08-014325 | | 1/1996 |
| JP | 08-120234 | | 5/1996 |
| JP | 9-24927 | A | 1/1997 |
| JP | 09-035934 | | 2/1997 |
| JP | 09-118305 | | 5/1997 |
| JP | 11115924 | A | 4/1999 |
| JP | 2003-20080 | A | 1/2003 |
| JP | 2005206166 | A | 8/2005 |
| JP | 2006312491 | A | 11/2006 |
| JP | 2009-269645 | A | 11/2009 |
| WO | WO 94/08541 | A1 | 4/1994 |
| WO | WO 2004/036606 | A1 | 4/2004 |
| WO | WO 2004/076178 | A1 | 9/2004 |
| WO | WO 2007/068882 | A1 | 6/2007 |
| WO | 2008/153954 | A1 | 12/2008 |
| WO | WO 2008/152344 | A1 | 12/2008 |
| WO | WO 2008/153953 | A1 | 12/2008 |
| WO | 2009/012627 | A2 | 1/2009 |
| WO | 2009/151504 | A1 | 12/2009 |

* cited by examiner

RELEASABLY CLOSABLE PRODUCT ACCOMMODATING PACKAGE

CROSS REFERENCE TO RELATED APPLICATIONS

This application is the National Stage of International Application No. PCT/US2011/057982, which designates the U.S., filed 27 Oct. 2011, which claims the benefit of U.S. Provisional Patent Application No. 61/407,385 filed Oct. 27, 2010; U.S. Provisional Patent Application No. 61/408,091, filed Oct. 29, 2010; and U.S. Provisional Patent Application No. 61/408,112, filed Oct. 29, 2010, the contents of all of which are incorporated herein by reference in their entirety.

FIELD OF THE INVENTION

The present invention relates generally to a package for accommodating and dispensing product. More particularly, the present invention relates to a dual compartment package having a releasable closure which permits repeated opening and closing of the compartments of the package.

BACKGROUND OF THE INVENTION

Various packaging devices exist for accommodating and dispensing consumable products. Such packages may be designed to permit repeated opening and closing to access the product contained therein. One type of reopenable package includes a package having a product accommodating compartment and a foldable flap cover.

An example of one such package for accommodating and dispensing sticks or slabs of gum is shown in commonly assigned U.S. Pat. No. 7,159,717 where the package includes two compartments separated by a hinge where the two compartments may be foldably closed over one another to arrange the package between an open position permitting dispensing of the chewing gum slabs therefrom to a closed position.

In order to maintain the folded package in a closed position, the package shown in the '717 patent includes a foldable flap which is folded over the two compartments and tucked into a slot. To open the package, the flap must be removed from the slot and hingedly lifted to permit opening of the package compartments.

Another example of a package for gum sticks or slabs is shown in commonly assigned U.S. Pat. No. 7,533,773. In this embodiment, a cover overlies a packet. The cover has an openable flap which also opens the packet. As with the embodiment of the '717 packet, the flap is closed by tucking the flap into a slot on the front wall of the cover.

Other examples of gum packages are known which use a foldable flap to cover a dispensing opening.

It is desirable to provide a dual compartment package for accommodating and dispensing consumable products such as chewing gum which provides a further releasable closure mechanism.

SUMMARY OF THE INVENTION

In an embodiment of the present invention, a package assembly is provided for accommodating and dispensing a plurality of elongate consumable products. A package housing is provided for supporting the products. The package housing includes a first product accommodating compartment and a second product accommodating compartment which are separated by a hinge. Each product accommodating compartment has an open end adjacent the hinge. The product accommodating compartments are foldable about the hinge in a book-like fashion. A releasable closure is applied to each compartment and positioned to be in aligned facing relationship for mutual engagement upon closably folding the compartments about the hinge. The releasable closure is selected from the group consisting of a clip, mating hook and loop fasteners, magnetic fasteners, pressure sensitive labels, static cling film, pressure sensitive adhesives and interfitting mechanical devices.

DETAILED DESCRIPTION OF THE PREFERRED EMBODIMENT

The present invention provides a releasable closure for packaging. It is contemplated that the releasable closure may be used to permit the reopenable closure of a package. In its broad aspect, the present invention employs a closure device to hold two compartments of the package closed. When these packaging components are opened, they provide access to the contents of the package.

As used herein throughout, the term "releasable closure" or "releasable closure device" may refer to a wide variety of mechanisms and/or materials, which when joined together form a releasable coupling. When such materials and/or mechanisms are placed on two portions or compartments of a package, it provides for the releasable coupling of those portions. Various non-limiting examples will be described hereinbelow.

The present invention in one aspect applies or affixes a releasable closure to a product package having two product accommodating compartments or portions mutually closable about a hinge member.

Figure 2:
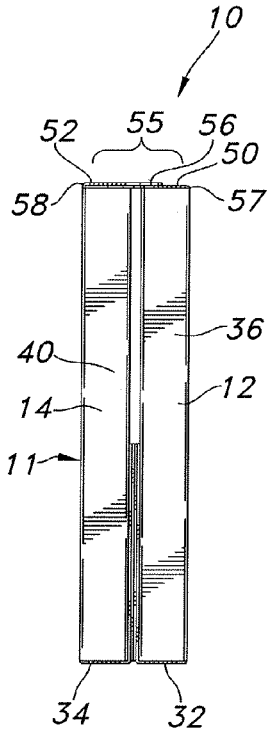
FIG. 2 is a perspective showing of the package of FIG. 1 in the closed condition.
Figure 1:
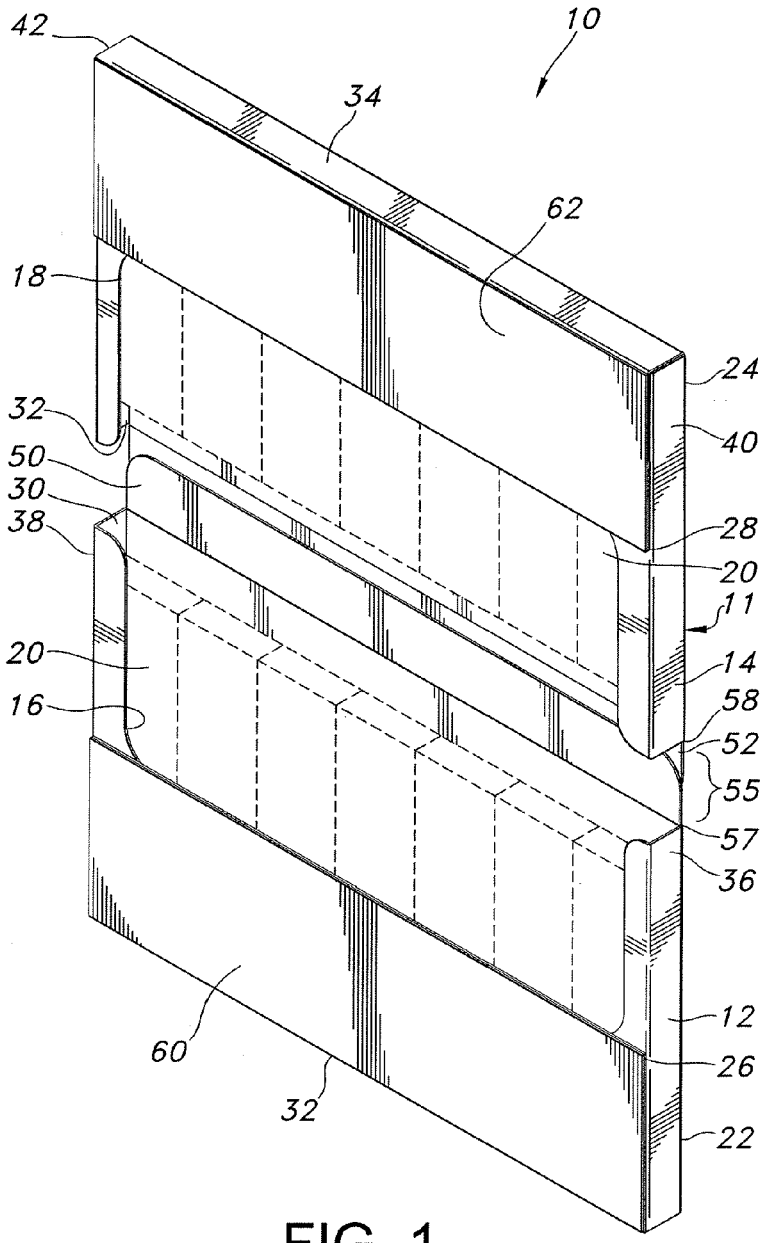
FIG. 1 is a perspective showing of one embodiment of a package of the present invention, for accommodating gum slabs, shown in the opened condition.

FIGS. 1 and 2 show one embodiment of the present invention. The package shown herein is a hand-held, pocket-sized package for accommodating and dispensing a plurality of consumable products. In the present embodiment, the products may include gum slabs which may have individual wrappers thereover. The package includes a pair of compartments in a book-like configuration where the package may be opened and closed about either side of a hinge member. The package is releasably maintained in the closed position by use of a releasable closure affixed or otherwise applied to the compartments on one or both sides of the hinge member.

Package 10 may also be provided with an overwrap (not shown) to environmentally seal the contents of the package. If desired, the overwrap may employ a tamper evident strip.

Package 10, includes a package housing 11, and is generally formed of paperboard material folded from a flat blank. While paperboard is the preferred material, other well known materials and combinations thereof may also be employed. Such materials may include paperboard, cardboard, laminates, foils and combinations thereof. The package 10 of the present invention may be formed from a single flat paperboard blank or a pair of paperboard blanks secured to one another.

The paperboard blank or blanks are arranged into the configuration shown in FIG. 1 to form a pair of compartments 12 and 14. Each of compartments 12 and 14 forms, respectively, product accommodating pockets 16 and 18. The pockets 16 and 18 support a plurality of gum slabs 20 in a side-by-side upright array. While such an arrangement of gum slabs is shown, other arrangements of the gum slabs in the pockets are contemplated. Also, the gum slabs may be releasably retained in the pockets by a releasable adhesive or other means. An example of such a releasable adhesive is a low temperature hot melt glue which may be applied inside pockets 16 and 18. Each of pockets 16 and 18 is defined by respective back walls 22 and 24 and respective front walls 26 and 28. While the back walls extend fully upwards over the supported gum slabs, the front walls extend only partially upwards to provide an open end 30 and 32, respectively, for providing dispensing access to the gum slabs 20. End walls 32 and 34, as well respective side walls 36, 38 and 40, 42, bound the open ended pockets 16 and 18. Each of the back walls 22 and 24 of the compartments 12 and 14 has an upwardly extending edge 50 and 52. As particularly shown in FIGS. 1-2, the edges 50 and 52 may be overlapped and secured together in the situation where the compartments are formed by separate blanks to form the assembled package housing 11. As is shown in FIG. 1, in the open condition, the open ends 30 and 32 of packets 16 and 18 are preferably in facing relationship.

As will be described in further detail hereinbelow, the location where edges 50 and 52 overlap, forms a hinge member 55 for providing foldable closure of the package housing 11 in book-like fashion from an opened condition shown in FIG. 1 to a closed condition shown in FIG. 2. The hinge member 55 is defined by a hinge spine 56 and a pair of hinge joints 57 and 58 on either side thereof. As may be appreciated from FIGS. 1 and 2, the package housing 11 may be opened in book-like fashion about hinge member 55 to render accessible the gum slabs 20 and to dispense the gum slabs from the open pockets 16 and 18. The package housing 11 may be moved to a foldably closed position as shown in FIG. 2 to prevent access to the open pockets 16 and 18 and prevent removal of the gum slabs 20 therefrom. Thus, in typical use, the consumer will maintain the package housing 11 in a closed condition as shown in FIG. 2 until such time as it is desired to remove one or more gum slabs therefrom. At that time, the consumer would open the package housing 11 about hinge member 55 to the opened condition shown in FIG. 1. The desired number of gum slabs 20 can be removed from pockets 16 and 18 and then the consumer can reclose the package housing 11 to a condition shown in FIG. 3. The package is designed to be repeatedly opened and closed as required by the needs of the consumer.

While the package of the present invention is opened about a hinge, other types of openable movement between these compartments are contemplated. Such other types of structure may include, for example, a slide cover.

In order to maintain the package housing 11 in a closed condition, the present invention employs a releasable closure applied or otherwise affixed to the compartments 12 and 14.

In the present embodiment, the locations 60 and 62 on front walls 26 and 28 schematically represent the general placement of the releasable closure material. The package housing will be releasably retained in closed condition by the engagement of the locations 60 and 62. However, this engagement is such that, while maintaining the package housing 11 in a closed condition, it can be easily released by the consumer and the package housing can be articulated from the closed condition to the open condition. This allows repeated opening and closing of the package. The closure is such that while it may be easily opened, it maintains closure under gravitational forces.

Non-limiting examples of releasable closures or releasable closure devices are described herein. In addition, one example of a releasable closure is shown and described in the above incorporated provisional applications and in PCT International Application No. PCT/US2011/054119, filed Sep. 30, 2011, which is incorporated herein by reference for all purposes. Each of the below embodiments are employed on packages substantially similar to that shown and described above. Therefore, similar reference numerals will be used to denote similar elements.

Figure 3:
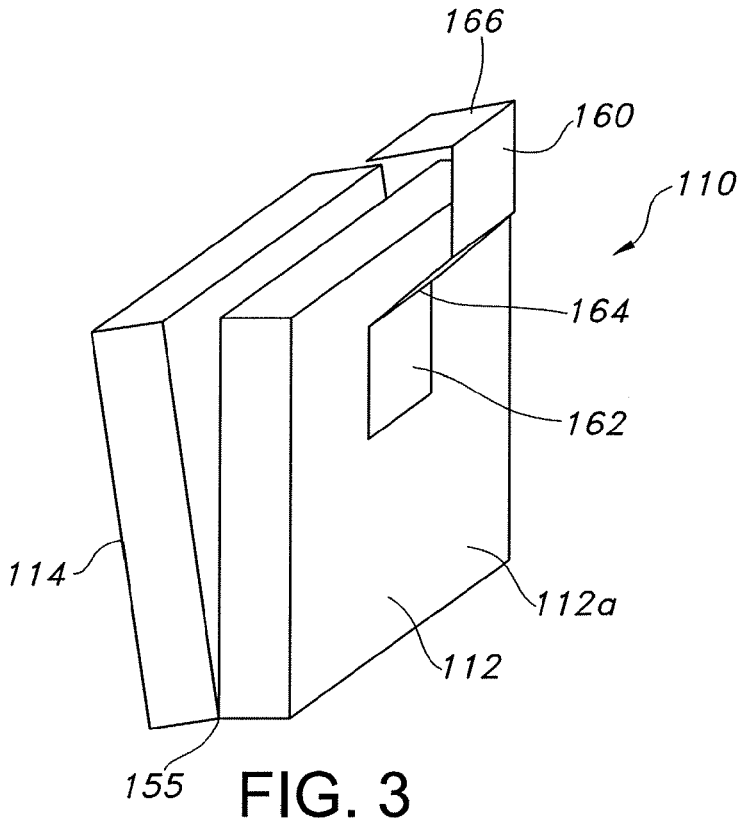
FIGS. 3-13 show examples of releasable closures and/or releasable closure devices for packages in accordance with the present invention.
Figure 4:
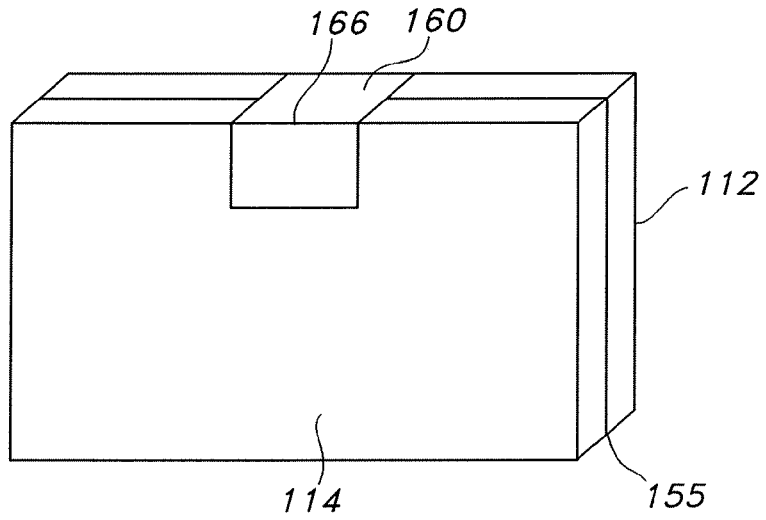

Referring now to FIGS. 3 and 4, one example of releasable closure device of the present invention is described. Package 110 includes a pair of product accommodating compartments 112 and 114 coupled by a hinge 155 for foldable movement between open and closed positions. In order to maintain the compartments 112 and 114 in closed position, as particularly shown in FIG. 4, a plastic clip 160 is employed. Plastic clip 160 includes a member 162 for adhesive securement to the back 112*a* of compartment 112. A U-shaped clip 166 portion is connected to the member 162 at a living hinge 164. The clip portion 166 is hingedly movable about the living hinge 164 so that the clip can be manipulated over the upper edges of the closed compartments 112 and 114 to provide releasable closure thereof. It is contemplated that the dimension of the clip portion is such that it provides a frictional engagement with the compartments. When the clip portion is positioned as shown in FIG. 3, the compartments can be opened. The clip portion can be moved to the position shown in FIG. 4 to close the compartments. The clip is releasable so as to provide for repeated opening and closing of the package.

Figure 5:
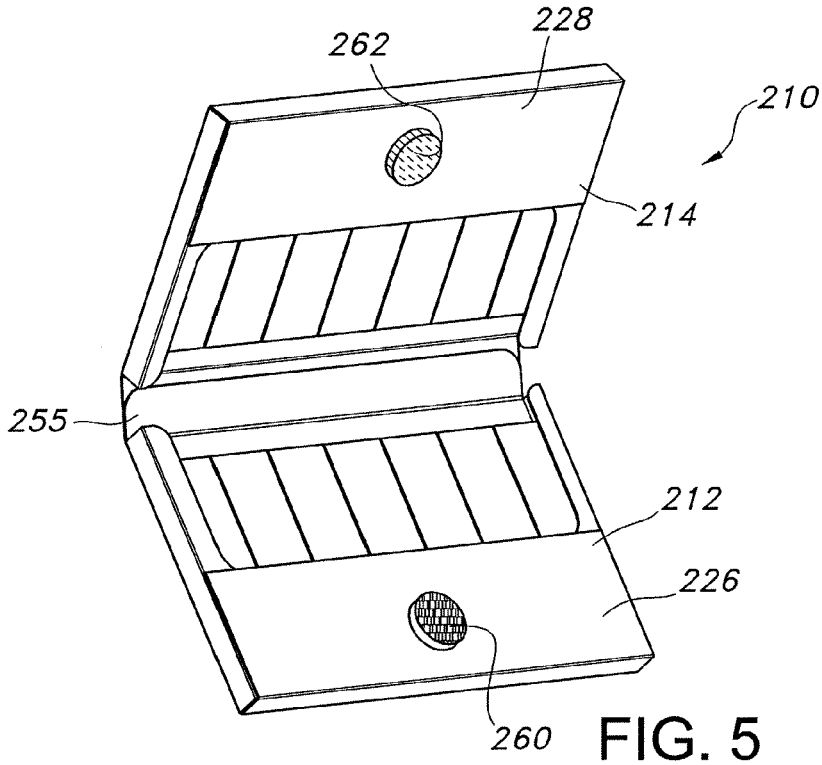

Referring now to FIG. 5, package 210 is shown. Package 210 includes a pair of product accommodating compartments 212 and 214 separated by a hinge member 255 for foldable movement between open and closed positions. The closure shown in FIG. 5 includes hook and loop fasteners which may be of the type sold under the trademark Velcro®. One such fastener 260 is applied to the front wall 226 of compartment 212. A mating fastener 262 is applied to the front wall 228 of compartment 214. The fasteners 260 and 262 are arranged to be in opposing mutual alignment. When the compartments 212 and 214 are closed about hinge 255, the fasteners 260 and 262 engage maintaining the package 210 in releasably closed position.

Figure 6:
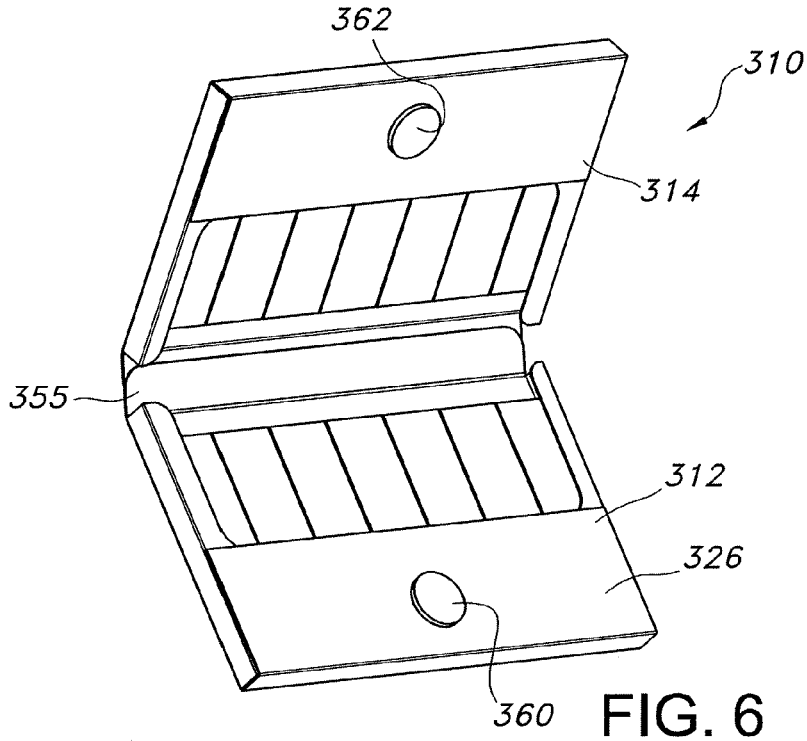

Referring now to FIG. 6, a package 310 is shown. Package 310 includes a pair of product accommodating compartments 312 and 314 separated by a hinge member 355 for foldable movement between open and closed positions. The closure shown in FIG. 6 includes magnetic fasteners to effect reopenable closure of the package 310. The magnetic fasteners may be of the type including magnets, magnetic material or magnetizable material. It is contemplated that the magnetic fasteners may include two mutually engageable magnetic materials or a magnet in combination with a magnetic attractive material.

One such magnetic device 360 is applied to the front wall 326 of compartment 312. Another magnetic device 362, which is attractive to device 360, is applied to the front wall 328 of compartment 314. The magnetic devices 360 and 362 are arranged to be in opposing mutual alignment. When the compartments 312 and 314 are closed about the hinge 355, the magnetic devices 360 and 362 engage maintaining the package 310 in releasably closed position.

Figure 7:
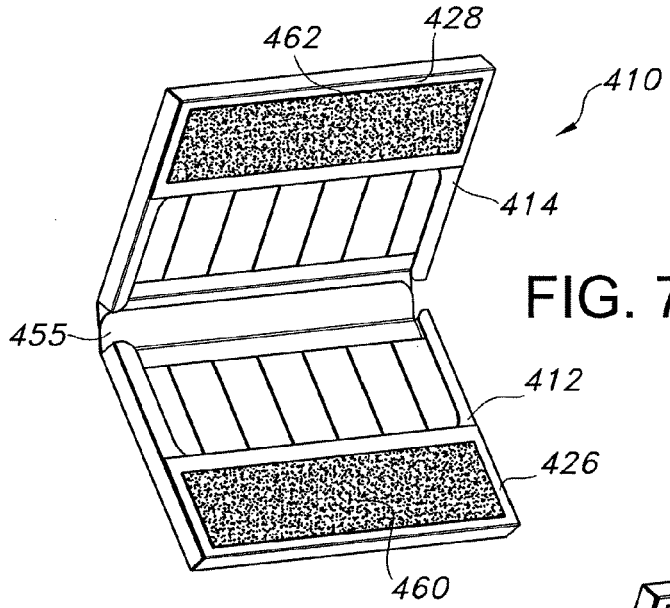

Turning now to FIG. 7, package 410 is shown. Package 410 includes a pair of product accommodating compartments 412 and 414 separated by a hinge member 455 for foldable movement between open and closed positions. The closure shown in FIG. 7 includes pressure sensitive labels. The pressure sensitive labels include pressure sensitive adhesive thereon which is of the type which is releasably co-engageable. Thus, one such label 460 is applied to the front wall 426 of compartment 412. Another such label 462 is applied to the front wall 428 of compartment 414. The labels are positioned and arranged to be in opposing mutual alignment. When the compartments 412 and 414 are closed about hinge 455, the labels 460 and 462 engage maintaining the package in releasably closed position.

Figure 8:
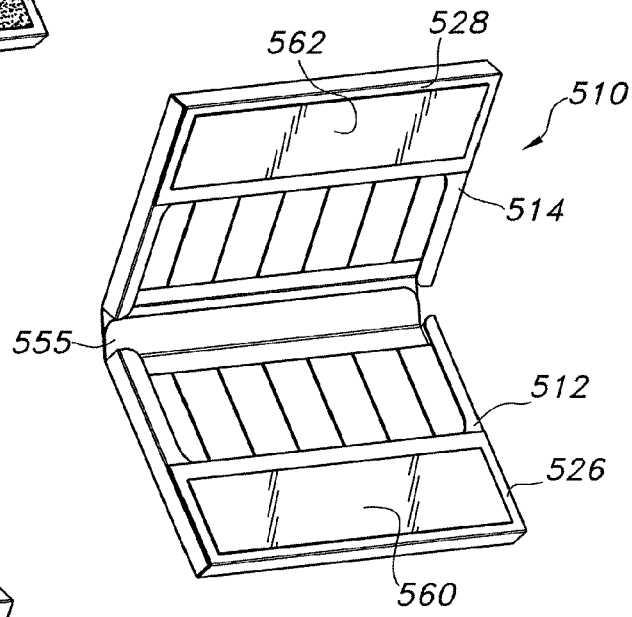

FIG. 8 shows a further embodiment of a package 510 in accordance with the present invention. Package 510 includes a pair of product accommodating compartments 512 and 514 separated by a hinge 555 for foldable movement between open and closed positions. As shown in FIG. 8, a closure is provided by a static cling films which are mutually engageable by static friction. One such film 560 is applied to the front wall 526 of compartment 512. Another such film 562 is applied to the front wall 528 of compartment 514. The static cling films 560 and 562 are arranged to be in opposing mutual alignment. When the compartments 512 and 514 are closed about hinge 555, the static cling films 560 and 562 engage maintaining the package in releasably closed position.

Figure 9:
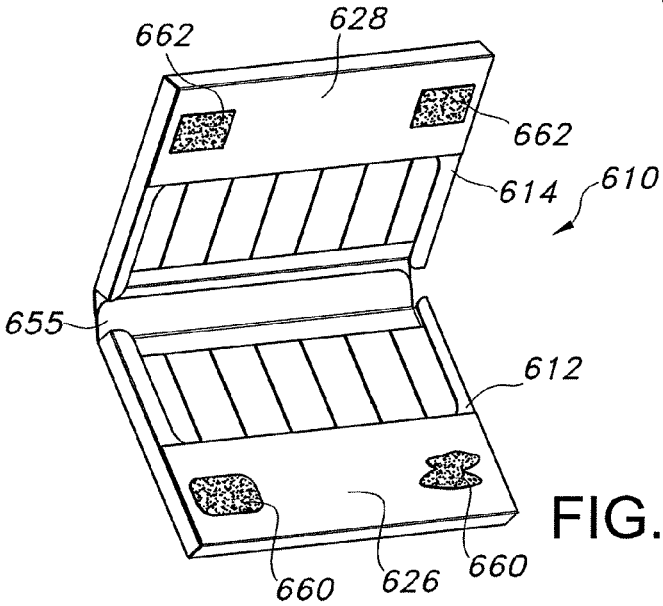

FIG. 9 shows a package 600 constructed in accordance with the present invention. Package 600 includes a pair of product accommodating compartments 612 and 614 separated by a hinge member 655 for foldable movement between open and closed positions. The closure shown herein includes pressure sensitive adhesive applied to the package and which is releasably attachable to various surfaces. In the present illustrative embodiment, pressure sensitive adhesive is applied at locations 660 on the front wall 626 of compartment 612. The pressure sensitive adhesive locations 660 are releasably engageable with locations 662 defined by the front wall 628 of compartment 614. Thus, when compartment 614 is closed upon compartment 612, the pressure sensitive adhesive locations 660 provide for releasable closure of the package 610. The pressure sensitive adhesive location may be provided in a wide variety of configurations.

FIGS. 10-13 show various interfitting mechanical devices which may be employed as releasable closures. These devices typically include two components which interfit or interlock to provide removable connection therebetween. One component is placed on the front wall of one compartment while the other interfitting component is placed on the front wall of the other compartment.

Figure 10:
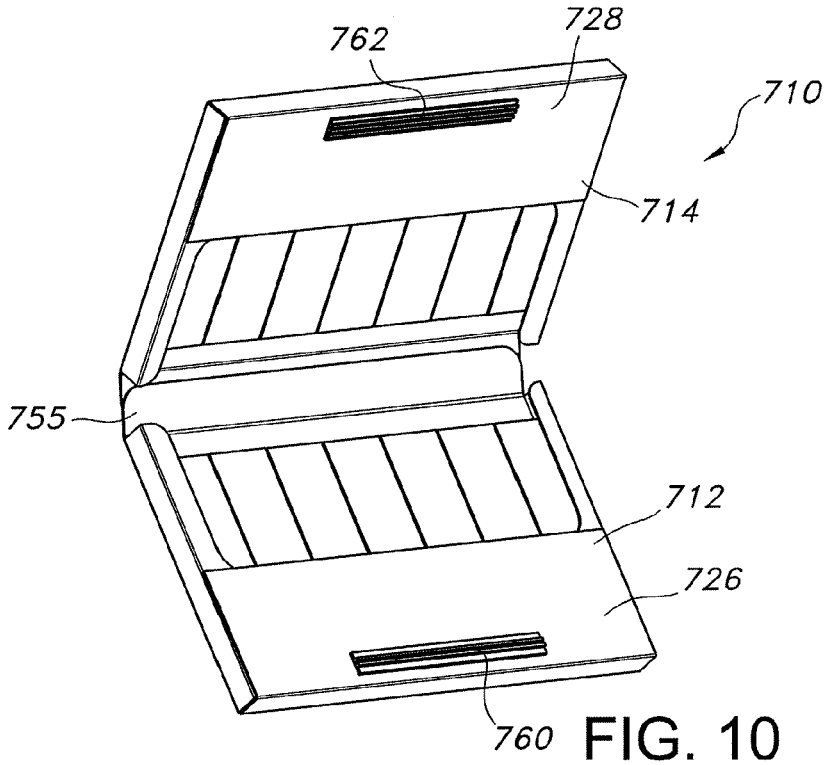

Referring now to FIG. 10, a package 710 in accordance with the present invention is shown. Package 710 includes a pair of product accommodating compartments 712 and 714 separated by a hinge member 755 for foldable movement between open and closed positions. The closures shown in FIG. 10 include a zipper-type or "zip lock" closure of generally conventional construction similar to those found on resealable bags. As is well known, the zip lock fastener includes an extending member which is insertable into a receiving member. One such zip lock member 760 is applied to the front wall 726 of compartment 712. The mating zip lock member 762 is applied to the front wall 728 of compartment 714. The zip lock fasteners are arranged to be in opposing mutually alignment. Thus, when the compartments 712 and 714 are closed about hinge 755, the zip lock fasteners 760 and 762 engage maintaining the package 710 in releasably closed position. Sliding pressure along the edge of the closed package may be used to effect "locking" of the closure.

Figure 11:
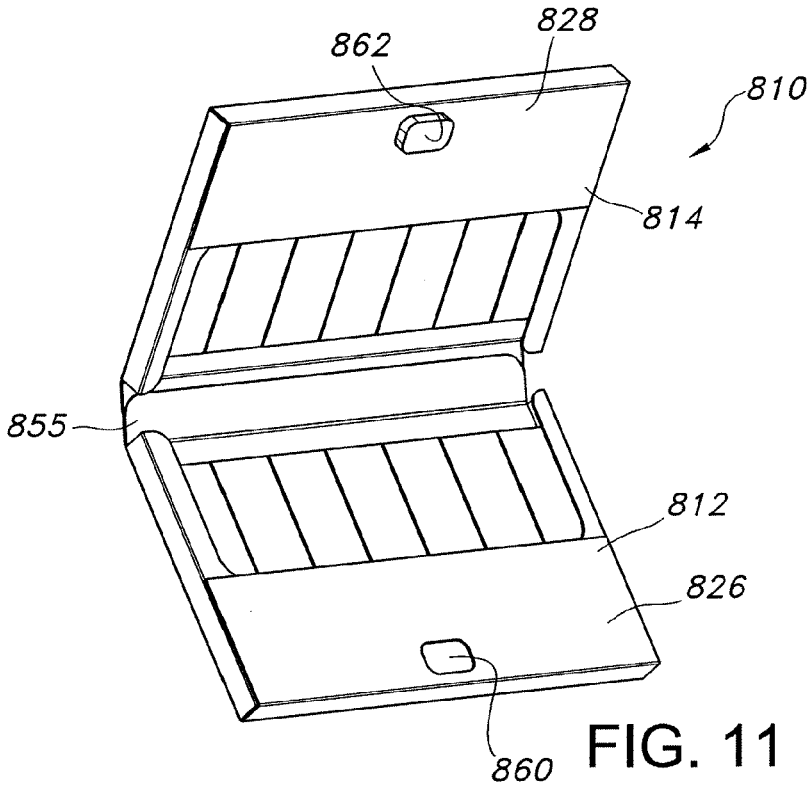

Referring now to FIG. 11, a further embodiment of the present invention is shown. Package 810 includes a pair of product accommodating compartments 812 and 814 separated by a hinge member 855 for foldable movement between open and closed positions. The closure shown in FIG. 11 is of the type described as a latch and receptacle. The closure includes a latch 862 having a protruding portion **862*a* and a receptacle 860 which receives protruding portion 862*a*. As an example, the receptacle 860 is applied to the front wall 826 of compartment 812, the latch 862 is applied to front wall 828 of compartment 814. The compartments 812 and 814 are closed about hinge 855. The protruding portion 862*a* of latch 862 is inserted into receptacle 816 and frictionally retained therein in a manner which permits release therefrom. This provides for releasable closure of package 810**.

Figure 12:
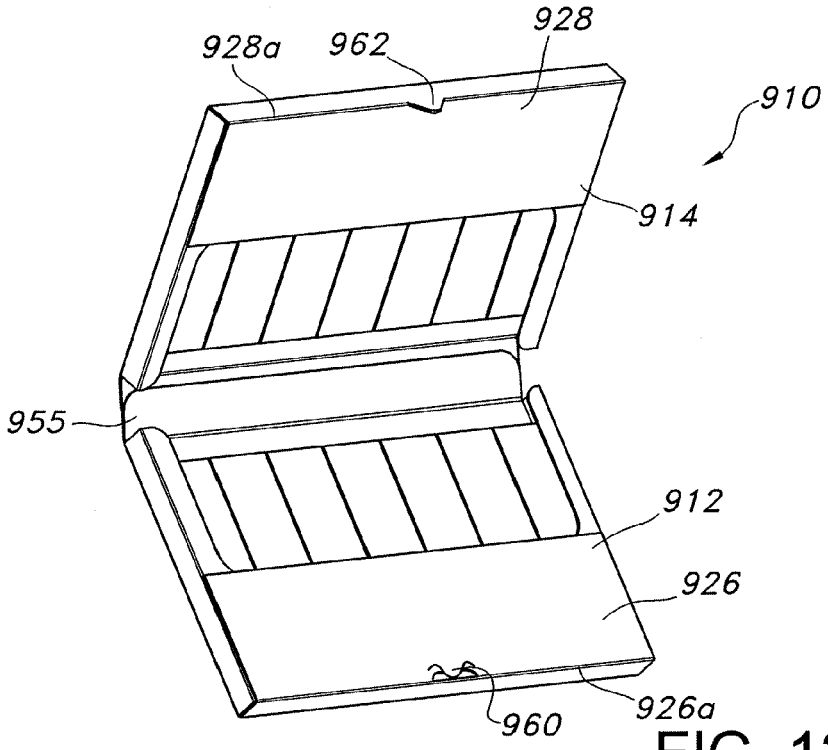
Figure 13:
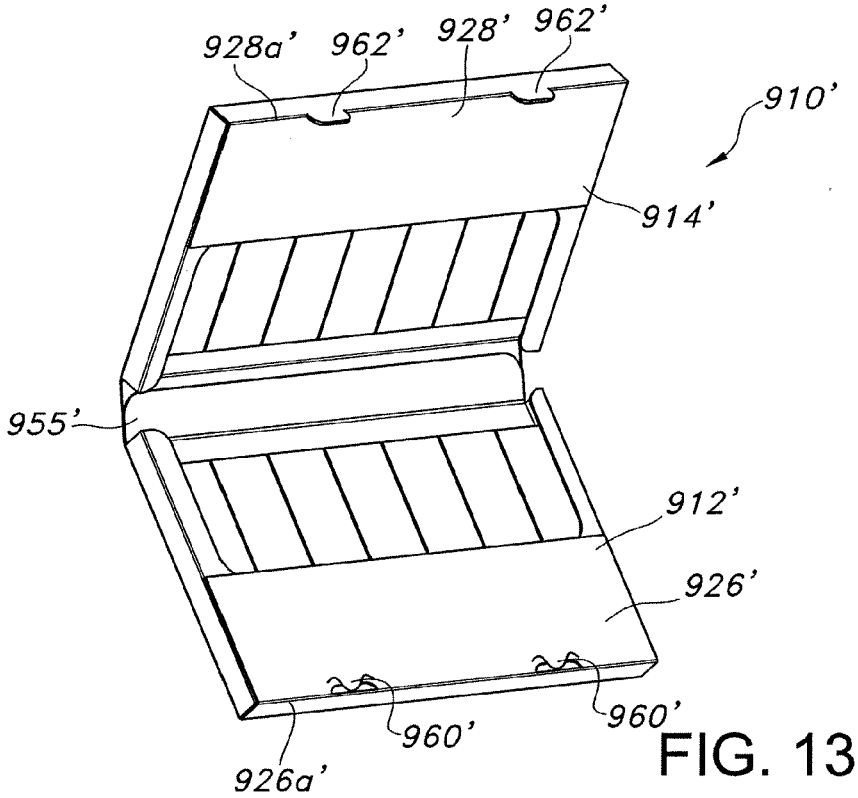

Referring now to FIGS. 12 and 13, two embodiments of tab-like closures are shown.

FIG. 12 shows a package 910 having a pair of compartments 912 and 914 separated by a hinge member 955 for foldable movement between open and closed positions. The closure device employed herein is a tab and receptacle closure. In the embodiment in FIG. 12, a centrally located extending tab 962 formed from the paperboard blank forming the package 910 extends perpendicularly outward from front wall 928 of compartment 914 along the distal edge **928*a* thereof. A receiving aperture 960 is formed on the front wall 926 of compartment 912 at a location adjacent the distal edge 926*a* thereof. In the embodiment shown in FIG. 12, a single tab 962 is centrally located to be received in a centrally located receptacle 960. The tab 962 is received in the receptacle 960 in frictional engagement. When the compartments 912 and 914 are closed about hinge 955, the tab 962 enters the receptacle 960 and is held therein in releasable frictional engagement thereby maintaining the package 912** in releasably closed position.

FIG. 13 shows a similar embodiment to that shown in FIG. 12 where package 900' includes compartments 912' and 914' arranged about hinge 955' for foldable movement between open and closed positions. In the embodiment in FIG. 13, two spaced apart tabs 962' along edge **928*a*' of compartment 914' are engageable with a pair of aligned receptacles 960' along edge 926*a*' of compartment 912'**.

One or more of the embodiments described above, with respect to the releasable closure and/or releasable closure devices, provide various consumer benefits. For example, the particular closures described herein may provide the consumer with the ability to operate the opening and closing of the package by one hand. The release of the closure mechanism to open the package from the closed position to the open position may be capable by the consumer using a thumb in a sliding fashion or a fingernail between the closed compartments.

Additionally, in certain situations and with the use of certain closure materials and closure devices, the opening and closing of the package would be noiseless. However, in other situations, it may be desirable to employ a releasable closure in accordance with the present invention which provides an audible click upon closing to indicate that the package is closed.

In addition, the releasable closures or closure devices of the present invention may be employed in combination with a wide variety of materials forming the package.

It is further contemplated that one or more of the above-described closures can be placed in various numbered arrangements and configurations on the package compartments. Also, the strength of the releasable closure can be varied depending on the particular closure, its arrangement, number and configuration. For example, the amount of adhesive and the adhesive properties of the adhesive can be adjusted. The magnetic strength of the magnetic materials employed can be adjusted. The size and location and amount of releasable closures can be provided and arranged to suit various needs.

Items:

Item 1. A package assembly for accommodating and dispensing a plurality of elongate consumable products comprising:

a package housing for supporting said products;

said package housing including a first product accommodating compartment and a second product accommodating compartment separated by a hinge;

each said product accommodating compartment having an open end adjacent said hinge, said product accommodating compartments being foldable about said hinge in a book-like fashion; and a releasable closure on each compartment and positioned to be in aligned facing relationship for mutual engagement upon closably folding said compartments about said hinge;

wherein said releasable closure is selected from the group consisting of: a clip, mating hook and loop fasteners, magnetic fasteners, pressure sensitive labels, static cling film, pressure sensitive adhesives and interfitting mechanical devices.

Item 2. A package assembly of item 1 wherein each said product compartment includes an open area defined by said open end and a closed area, and wherein said open area is greater than said closed area.

Item 3. A package assembly of item 2 wherein said closed area is defined by a front wall.

Item 4. A package assembly of item 3 wherein said front wall includes said releasable closure.

Item 5. A package assembly of items 1-4 wherein said clip is adhesively secured to one of said product accommodating compartments, said clip having a hinge and a portion removably attachable to said other product accommodating compartment for providing said releasable closing of said package housing.

Item 6. A package assembly of items 1-4 wherein said mating hook and loop fasteners includes said hook fastener being placed on one said compartment and said loop fastener being placed on the other said compartment.

Item 7. A package assembly of items 1-4 wherein said magnetic fasteners are separately applied to said compartments and are mutually attractable.

Item 8. A package assembly of items 1-4 wherein said pressure sensitive labels are separately applied to said compartments.

Item 9. A package assembly of items 1-4 wherein said static cling film is separately applied to said compartments.

Item 10. A package assembly of items 1-4 wherein said pressure sensitive adhesive is separately applied to said compartments.

Item 11. A package assembly of item 10 wherein said pressure sensitive adhesive is separately applied to selective locations on said front wall of said compartments.

Item 12. A package assembly of items 1-4 wherein said interfitting mechanical device includes mating zipper type locks.

Item 13. A package assembly of item 12 wherein said zipper type lock includes an extending member applied to one said compartment and an interfitting receiving member applied to the other said compontent.

Item 14. A package assembly of items 1-4 wherein said interfitting mechanical device includes a mating latch and receptacle, wherein said latch is placed on one of said compartments and said receptacle is placed on the other said compartment.

Item 15. A package assembly of items 1-4 wherein said interfitting mechanical device includes at least one mating tab and receptacle, wherein said tab is placed on one of said compartments and said receptacle is placed on the other said compartment.

Various changes to the foregoing described and shown structures would now be evident to those skilled in the art. Accordingly, the particularly disclosed scope of the invention is set forth in the following claims.

What is claimed is:

1. A package assembly for accommodating and dispensing a plurality of elongate consumable products comprising:

a package housing for supporting said products;

said package housing including a first product accommodating compartment and a second product accommodating compartment separated by a hinge;

said first and second product accommodating compartments being formed by separate blanks having edges, respectively;

said edges of said first and second product accommodating compartments being overlapped and secured together, thereby assembling the package housing, using an overlapped portion of the edges as said hinge, each said product accommodating compartment having an open end adjacent said hinge, said product accommodating compartments being foldable about said hinge in a book-like fashion; and a releasable closure on each compartment and positioned to be in aligned facing relationship for mutual engagement upon closably folding said compartments about said hinge;

wherein said releasable closure is selected from the group consisting of: a clip, mating hook and loop fasteners, magnetic fasteners, pressure sensitive labels, static cling film, pressure sensitive adhesives and interfitting mechanical devices.

2. A package assembly of claim 1 wherein each said product compartment includes an open area defined by said open end and a closed area, and wherein said open area is greater than said closed area.

3. A package assembly of claim 2 wherein said closed area is defined by a front wall.

4. A package assembly of claim 3 wherein said front wall includes said releasable closure.

5. A package assembly of claim 1 wherein said clip is adhesively secured to one of said product accommodating compartments, said clip having a hinge and a portion removably attachable to said other product accommodating compartment for providing said releasable closing of said package housing.

6. A package assembly of claim 4 wherein said mating hook and loop fasteners includes said hook fastener being placed on one said compartment and said loop fastener being placed on the other said compartment.

7. A package assembly of claim 4 wherein said magnetic fasteners are separately applied to said compartments and are mutually attractable.

8. A package assembly of claim 4 wherein said pressure sensitive labels are separately applied to said compartments.

9. A package assembly of claim 4 wherein said static cling film is separately applied to said compartments.

10. A package assembly of claim 4 wherein said pressure sensitive adhesive is separately applied to said compartments.

11. A package assembly of claim 10 wherein said pressure sensitive adhesive is separately applied to selective locations on said front wall of said compartments.

12. A package assembly of claim 4 wherein said interfitting mechanical device includes mating zipper type locks.

13. A package assembly of claim 12 wherein said zipper type lock includes an extending member applied to one said compartment and an interfitting receiving member applied to the other said compartment.

14. A package assembly of claim 4 wherein said interfitting mechanical device includes a mating latch and receptacle, wherein said latch is placed on one of said compartments and said receptacle is placed on the other said compartment.

15. A package assembly of claim 4 wherein said interfitting mechanical device includes at least one mating tab and receptacle, wherein said tab is placed on one of said compartments and said receptacle is placed on the other said compartment.

* * * * *